US008464875B2

(12) United States Patent
Blair et al.

(10) Patent No.: US 8,464,875 B2
(45) Date of Patent: Jun. 18, 2013

(54) APPARATUS FOR ANALYSING A SECURITY DOCUMENT

(75) Inventors: Ronald Bruce Blair, Flower Mound, TX (US); Alexandre Gret, Liebefeld (CH)

(73) Assignee: De la Rue International Limited, Basingstoke (GB)

( * ) Notice: Subject to any disclaimer, the term of this patent is extended or adjusted under 35 U.S.C. 154(b) by 270 days.

(21) Appl. No.: 12/451,767

(22) PCT Filed: Jun. 6, 2007

(86) PCT No.: PCT/GB2007/002068
§ 371 (c)(1),
(2), (4) Date: Feb. 23, 2010

(87) PCT Pub. No.: WO2008/149050
PCT Pub. Date: Dec. 11, 2008

(65) Prior Publication Data
US 2010/0163466 A1 Jul. 1, 2010

(51) Int. Cl.
*B07C 5/00* (2006.01)

(52) U.S. Cl.
USPC ..... 209/534; 209/589; 382/135; 194/206

(58) Field of Classification Search
USPC ..... 209/534, 589; 194/206; 382/135
See application file for complete search history.

(56) References Cited

U.S. PATENT DOCUMENTS

| | | | | |
|---|---|---|---|---|
| 987,868 | A | 3/1911 | Ellis | |
| 3,590,992 | A * | 7/1971 | Soderstrom | 209/534 |
| 4,183,989 | A | 1/1980 | Tooth | |
| 4,366,382 | A * | 12/1982 | Kotowski | 378/57 |
| 4,386,432 | A | 5/1983 | Nakamura et al. | |
| 4,536,709 | A | 8/1985 | Ishida | |
| 4,943,093 | A | 7/1990 | Melling et al. | |
| 4,980,569 | A | 12/1990 | Crane et al. | |
| 5,057,268 | A | 10/1991 | Muller | |
| 5,419,424 | A | 5/1995 | Harbaugh | |
| 5,468,971 | A | 11/1995 | Ebstein et al. | |
| 5,486,022 | A | 1/1996 | Crane | |
| 5,583,904 | A * | 12/1996 | Adams | 378/22 |
| 5,667,079 | A * | 9/1997 | Jongebloed | 209/589 |
| 5,810,146 | A | 9/1998 | Harbaugh | |
| 6,104,036 | A | 8/2000 | Mazowiesky | |
| 6,438,262 | B1 | 8/2002 | Bernardini et al. | |
| 6,474,695 | B1 | 11/2002 | Schneider et al. | |
| 6,647,091 | B2 | 11/2003 | Fenkart et al. | |
| 6,917,040 | B2 * | 7/2005 | Thierauf et al. | 250/341.6 |

(Continued)

FOREIGN PATENT DOCUMENTS

| | | |
|---|---|---|
| EP | 0 381 550 A1 | 8/1990 |
| EP | A-0-381-550 | 8/1990 |

(Continued)

OTHER PUBLICATIONS

International Search Report issued in Application No. PCT/GB2007/002076; mailed on Jan. 3, 2008.

(Continued)

*Primary Examiner* — Joseph C Rodriguez
(74) *Attorney, Agent, or Firm* — Oliff & Berridge, PLC

(57) ABSTRACT

We provide an apparatus and method for analysing a security document. An x-ray source is adapted to illuminate at least one inspection region of the security document when located at an inspection position. An x-ray detector adapted to receive x-rays from the at least one inspection region of the document and to generate a corresponding detector response. A processor analyses the detector response and generates an output signal indicative of the structure of the document in the at least one inspection region.

32 Claims, 5 Drawing Sheets

U.S. PATENT DOCUMENTS

| | | | | |
|---|---|---|---|---|
| 6,987,868 | B1 | 1/2006 | Atarashi et al. | |
| RE39,490 | E | 2/2007 | Cote et al. | |
| 7,656,995 | B2 * | 2/2010 | Robinson | 378/41 |
| 7,860,293 | B2 | 12/2010 | Schutzmann | |
| 2003/0142865 | A1 | 7/2003 | Hirota et al. | |
| 2003/0194052 | A1 | 10/2003 | Price et al. | |
| 2007/0122023 | A1 | 5/2007 | Jenrick et al. | |
| 2007/0154078 | A1 * | 7/2007 | He et al. | 382/135 |
| 2008/0090726 | A1 | 4/2008 | Eskra et al. | |
| 2010/0163466 | A1 | 7/2010 | Blair et al. | |
| 2010/0206779 | A1 | 8/2010 | Blair et al. | |

FOREIGN PATENT DOCUMENTS

| | | | |
|---|---|---|---|
| GB | 2 062 854 | A | 5/1981 |
| JP | A-2003-132470 | | 5/2003 |
| JP | A-2005-85163 | | 3/2005 |
| WO | WO 01/88860 | A1 | 11/2001 |
| WO | WO 2008/149051 | A1 | 12/2008 |

OTHER PUBLICATIONS

May 20, 2011 Office Action in U.S. Appl. No. 12/451,745.

Rendle et al., "An inexpensive device for the examination of light objects using soft x-rays," Measurement Science and Technology, May 21, 1990, pp. 986-988, vol. 1, No. 9, IOP Publishing Ltd, United Kingdom, XP-20066322A.

Nov. 13, 2007 International search report issued in International Application No. PCT/GB2007/002068.

Nov. 25, 2011 Office Action issued in U.S. Appl. No. 12/451,745.

EPO communication (EPO Form 2906 01.91 TRI) in European Application No. 07 733 083.5, issued on Aug. 2, 2012.

Feb. 26, 2008 International Search Report issued in International Patent Application No. PCT/GB2007/002071.

U.S. Appl. No. 13/669,086, filed on Feb. 23, 2010 in the name of Blair.

U.S. Appl. No. 12/451,766, filed on Feb. 18, 2010 in the name of Blair.

U.S. Appl. No. 12/451,745, filed on Feb. 24, 2010 in the name of Blair.

U.S. Appl. No. 13/456,069, filed on Apr. 25, 2012 in the name of Blair.

Jun. 12, 2012 Office Action issued in U.S. Appl. No. 12/451,766.

Oct. 12, 2012 Office Action issued in U.S. Appl. No. 12/451,766.

Mar. 9, 2012 Office Action issued in U.S. Appl. No. 12/451,745.

* cited by examiner

APPARATUS FOR ANALYSING A SECURITY DOCUMENT

FIELD OF THE INVENTION

The present invention relates to an apparatus and method for analysing a security document, in particular by use of an x-ray technique.

BACKGROUND TO THE INVENTION

There are now a number of well established techniques for increasing the security of certain types of document. Such "security documents" include banknotes (including paper and plastic currency), bonds, legal documents, identification documents and other documents where the authenticity of the document is extremely important.

Such documents are often provided with one or more overt or covert "security features", these including specialist inks, optically variable elements, watermarks, security threads, specialist printing techniques and particular substrate materials. These security features are used to authenticate or discriminate between documents either by manual inspection, or more often, by various automatic methods. For example, it is possible to use magnetic techniques to detect the presence of magnetic material in the security threads or printing inks. Certain printing techniques are also used which produce surface relief which can in turn also be detected automatically. Thus in many such automatic methods, various sensors are provided to generate data relating to the particular documents, the data from the security features in particular being used to distinguish between document types and between genuine and counterfeit documents. In many cases, various optical methods are used, in transmissive or reflective arrangements, including infrared and ultraviolet measurements, so as to distinguish between the different types of document in the desired manner.

There is an ongoing need to improve the range of methods by which automatic analysis of security documents may be performed. This not only provides additional performance in terms of the accuracy of distinguishing between document types, but also provides advantages in combating the ever increasing sophistication of counterfeit documents.

SUMMARY OF THE INVENTION

In accordance with a first aspect of the invention we provide apparatus for analysing a security document, comprising an x-ray source adapted to illuminate at least one inspection region of the security document when located at an inspection position, an x-ray detector adapted to receive x-rays from the at least one inspection region of the document and to generate a corresponding detector response, and a processor adapted to analyse the detector response and to generate an output signal indicative of the structure of document in the at least one inspection region.

We have realised that, with the use of an x-ray technique, the structure of security documents can be analysed and this information can be used to provide automatic analysis of the type of security document in question. X-rays are advantageous since they have a greater penetrative power than optical methods and also since, for many materials, their interaction with the materials differs significantly from the interaction at light wavelengths. The method performed by the apparatus may be achieved using a stationary document. This might be the case in apparatus where single documents are inspected. Alternatively it might be used in apparatus having a stack of documents for automatic feeding and processing and in which the analysis is performed according to the invention whilst the document is stationary in a feed tray containing the document stack. For example the next document to be fed (either top-most or bottom-most in the stack) may be that which is analysed, the end of the stack comprising the inspection position. Preferably, the apparatus further comprises a transport path for transporting the document through the inspection position wherein the apparatus is arranged such that the x-ray source illuminates the document when in the transport path. X-ray source and detector combinations and arrangements can be used to provide highly detailed spatial information regarding the document structure within the inspection region.

The use of x-rays allows a wealth of structure information to be obtained from the one or more inspection regions of the document. The x-ray information forming the detector response provides information in terms of one or more of the density, thickness or material type(s) within the said at least one inspection region. The degree to which the x-rays from the source interact with the material within the inspection region is dependent upon the material type, its thickness and its density. It will be appreciated therefore that thickness information may be obtained using such x-ray information individually, as may density information and information concerning different materials used in the at least one inspection region. A combination of these may be used. In some examples, the density of the document substrate, together with thickness information in some cases, may be used to inspect watermarks within an inspection region. As is known, watermarks are produced by causing density variations within a substrate such as a paper substrate, during the manufacture of the substrate. Such watermarks include image-bearing watermarks, ladder watermarks for use with windowed security threads, and also watermarks used to strengthen regions of high wear of documents, such as corners and edges. The x-ray information may also be used to distinguish between different compositions of inks, including magnetic inks, and indeed different printing techniques. For example intaglio printing comprises the application of amounts of ink of different thicknesses by the intaglio process, the thickness of such inks typically being significantly in excess of ink provided by other processes such as screen or offset printing. Thus the technique provides the ability to distinguish between different types of printing process in addition to different types of ink.

A further example of the use of x-rays in determining the structure in an inspection region is in examining the structure of optically variable elements. As is known, optically variable elements typically comprise a substrate, together with a reflective layer and an adhesive, at least one of which typically includes surface relief. The different material types, together with the surface relief provide the ability to generate corresponding x-ray contrast.

Yet a further example of the use of x-rays in structure determination is in the detection of folds within the document where two or more thicknesses of the material may be present. Folds exhibit good x-ray contrast due to the thickness of the document in the region of the fold being two or more times that of other regions.

Thus the x-ray contrast generated with any of the techniques mentioned above can be used to authenticate or discriminate between different types of security documents bearing such features within the inspected region or regions. As will be appreciated, the use of x-rays is advantageous since it can be used with many known security features and therefore with many of the millions of security documents already in circulation, such as banknotes.

The x-ray detector is typically a line scan detector such as a line scan camera. This provides advantages in terms of cost and in reducing the x-ray power used for a given transport path speed. It is however also envisaged as an alternative that an array scan or "imaging" detector may be used which produces two dimensional pixel array x-ray image information. Typically of course an equivalent image may be formed by the combination of line scans from a line scan detector.

An x-ray source providing an area of emitted x-rays in two dimensions may be used either with a line or area detector. It is preferred to obtain multiple line scans within the inspection region.

The security document may therefore be fed along the transport path by a leading edge wherein the length of the detector is preferably equal to at least that of the leading edge. This is a preferred arrangement in the case of a "short edge" feed for rectangular documents. The use of a "long edge" feed is also contemplated. In the case of the use of an array scan, such as an imaging detector, the image of the entire document or a part thereof, may be taken and used, regardless of the type of feed (short edge or long edge).

Preferably the x-ray source is located upon an opposite side of the inspection position (transport path) with respect to the x-ray detector so as to provide a transmissive arrangement. Thus the x-ray contrast in such an arrangement is generated by the transmissive arrangement. It is also however envisaged that, assuming the use of appropriate materials which re-emit or fluoresce in the x-ray frequency upon stimulation of x-rays from the source, that a reflective arrangement may be used either as an alternative to or in addition to the transmissive arrangement described. In this case, for the reflective arrangement, the source and detector may be positioned upon a similar side of the transport path. Thus the "sides" of the transport path may be thought of in terms of the opposing planar faces of the security documents in question.

Typically the x-ray source and/or detector are positioned approximately normally to the face of the document as it passes along the transport path, so as to maximise both the received signal and the spatial resolution of the data obtained.

The monitoring of the inspection region structure may be achieved by monitoring the positional variation in intensity of the x-ray data produced by the detector. Typically therefore the apparatus is arranged to generate sufficient x-ray contrast for the expected security features to be inspected.

The data are preferably processed by the "obtained" response from the detector (detector response), being compared with a predetermined response corresponding to that obtained from an "expected" document such as a genuine document. The comparison may involve the consideration of intensity or contrast thresholds and the number or proportion of pixels which pass such thresholds. Preferably however, the apparatus is adapted to generate an image of the inspection region formed from a number of detector responses generated at different locations for each document.

The processor is therefore preferably adapted to compare the image with one or more predetermined master images. A set of such master images may be provided, in the case of banknotes, for each particular denomination of a currency. Typically four such master images are provided for each denomination, currency type or issue, these relating to possible feed orientations. An image analysis process may be used to make the comparison and, as a result, an output is generated which is dependent upon the result of the image analysis process. This may involve a number of known techniques of image analysis, for identifying features within images. Typically some measure of correspondence between the obtained and predetermined response is produced as a result of the analysis and, provided such correspondence is sufficient, the documents may be determined as being of the same type as that of the corresponding master image.

The apparatus may be used as part of document sorting apparatus for example for rapidly sorting documents according to their type. It may also be used in a document authenticator for sorting genuine documents from counterfeit documents and of course it may be used in apparatus combining sorting and authentication functions. The apparatus finds particular use in banknote processing fields although it will appreciated that it may be used for processing other security documents.

It is envisaged that the apparatus will find particular advantage in high speed processing of documents, that is, in excess of 600 documents per minute.

In accordance with a second aspect of the present invention we also provide a method of analysing a security document, the method comprising illuminating at least one inspection region of the security document with x-rays from an x-ray source, whilst the document is in an inspection position, receiving x-rays from the at least one inspection region at an x-ray detector adapted to generate a corresponding detector response, analysing the detector response so as to generate an output signal indicative of the structure of document within the at least one inspection region.

The method therefore is preferably performed by the functioning, during use, of the apparatus according to the first aspect.

Typically the method further comprises transporting the security document to and from the inspection position along a transport path.

It will be understood that preferably the document is in motion whilst the x-rays are received. Indeed it is preferred that each of the steps is performed, including the analysis, whilst the document is in motion.

The data representative of the detector response are preferably processed so as to modify the intensity contrast as part of the analysis. The data may also be processed so as to reduce noise. Each of these processing steps aids the correct analysis of the data. In simple cases the analysis may comprise comparing the detector response with a threshold intensity level, or indeed an intensity range and processing the document accordingly. Preferably however, the analysis comprises comparing the detector response with one or more master patterns corresponding to expected document types. The method can therefore be used to determine whether the inspection region contains a watermark, optically variable element or other security feature and analyse the structure of such a security feature.

The output signal may take the form of a data flag or a control signal for use by other apparatus. In general the signal is at least of a binary format, being indicative of whether the document is of an expected type or an unexpected type. The signal may comprise a number of different possible values or categories, such as a number of different expected and/or unexpected document types, dependent upon the analysis performed. In most cases, the output signal is used to control the further processing of the documents downstream. Thus the method may further comprise diverting documents of an expected type along a first transport path and those of an unexpected type along a second document path. The documents may then be provided to appropriate output trays or to other apparatus for further processing.

BRIEF DESCRIPTION OF THE DRAWINGS

Some examples of an apparatus and method according to the present invention will now be described with reference to the accompanying drawings, in which:—

DETAILED DESCRIPTION OF EXAMPLES

We now describe some examples of document processing apparatus in which the apparatus is adapted for processing documents in the form of banknotes.

Figure 1:
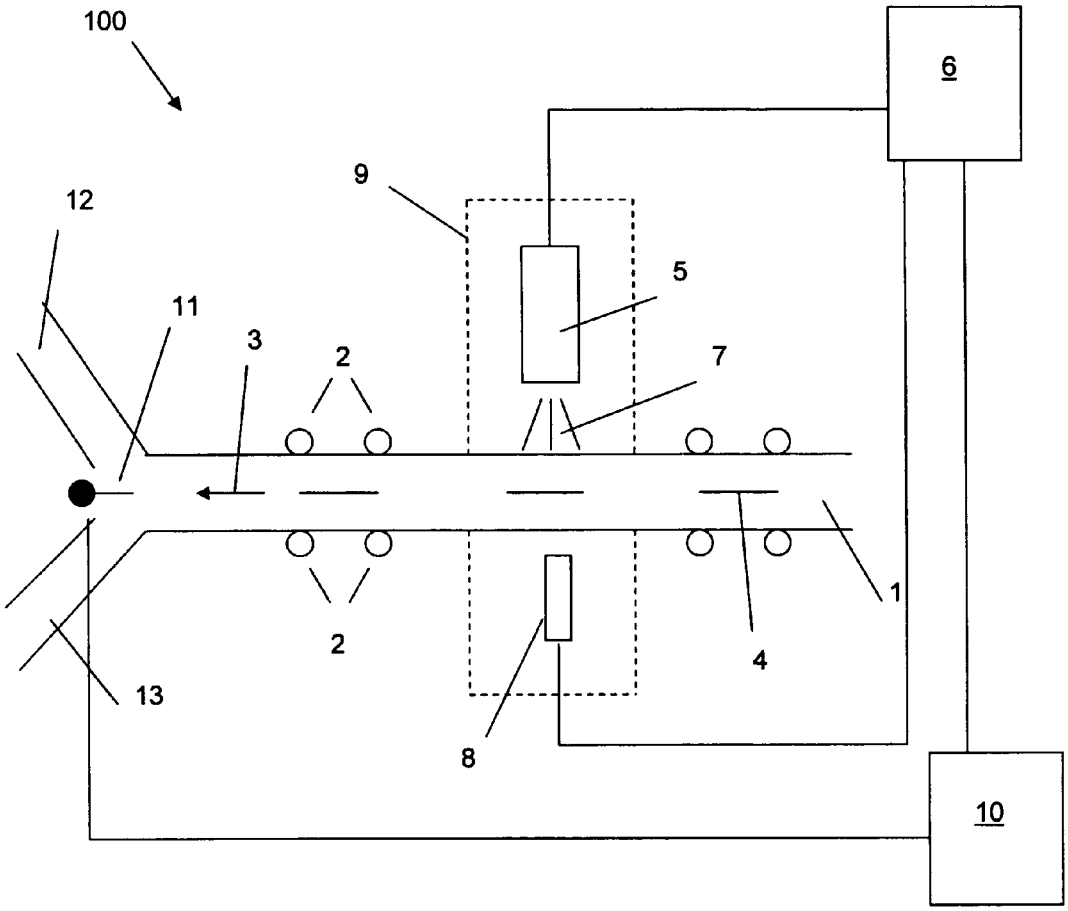
FIG. 1 is schematic representation of an example apparatus.

In FIG. 1, a first example is shown with the apparatus generally indicated at 100. A document transport path is illustrated at 1, this comprising a number of driven and idler rollers indicated at 2 (the drive mechanism not being shown). The rollers 2, together with various guide members and belts, securely drives banknotes along the transport path in a direction indicated by the arrow 3.

Three example banknotes 4 are shown within the transport path. As will be appreciated, FIG. 1 is schematic and therefore the separation between the opposing sides of the transport path (upper and lower in FIG. 1) is present only for clarity in illustrating the operation of the apparatus 100.

An x-ray source 5 is shown positioned within close proximity of the transport path and arranged to have an emission axis approximately normal to the surface of the banknotes 4. A typical separation between the surface of the banknote and the x-ray source 5 is a few centimetres in this example. The x-ray source has a typical operational voltage of few tens of kilovolts, in this case 40 kV. Typical operational currents lie within the range of a few tens of milliamperes, for example 14 mA.

The operation of the x-ray source is governed by a control system 6, this allowing control over the x-ray source voltage and current. Thus the intensity of x-rays emitted from the x-ray source is controllable by the controller 6. In the present example, when in use, the x-ray source emits a beam of x-rays which impinge upon the surface of the banknotes 4. This may be constrained by the use of an aperture, for example to illuminate only part of the target banknote.

An x-ray detector 6 is located upon the opposite side of the transport path 1 from the source 5. The detector is positioned so as to receive x-rays from one or more inspection regions of the banknote 4. The x-rays have either passed through the banknote 4 from the source 5 or have been generated by interaction between the x-rays 7 with the material within (including adhered to) the banknote 4 causing emission of x-rays from the material (fluorescence). The detector 8 takes the form of a line scan camera. The detector 8 extends in a direction normal to the plane of FIG. 1, this including the full width of the banknotes 4 within the transport path in the present example. A typical spatial resolution for such a camera is around 0.2 mm.

The detector 8 receives x-rays from the banknote 4 across the width of the transport path and converts the received x-rays into corresponding data which are provided to the controller 6. It should be noted that the x-ray source 5 and x-ray detector 8 are illustrated very schematically within FIG. 1, for example the figure not showing ancillary devices such as power sources for these components.

The apparatus complies with x-ray safety standards due to the use of an appropriately compliant x-ray source and due to the presence of a shielding system illustrated at 9. The shielding system comprises an x-ray absorptive enclosure constructed from a metallic material such as lead. A narrow slot within opposing walls of the shielding system 9 provides access for the transport path 1 passing through the shielding system 9.

The transport path 1 illustrated in FIG. 1 is intended to represent generically a number of possible transport path systems. Once example system provides a banknote transfer rate in excess of 1 metre per second. In some cases, a speed of around 10 metres per second may be achieved.

The controller 6 is operated by a computer system 10. The computer 10 uses the data received from the detector to determine whether the banknote 4 is of an "expected" type or an "unexpected" type. This is described later with reference to FIG. 6. Having determined the type of banknote using the data provided by the detector 8, the computer 10 controls the operation of a gate 11 positioned downstream of the detector 8. The gate 11 causes the banknotes to be deflected down one of two possible paths, a first path 12 being for the expected documents and the second path 13 for the unexpected documents.

"Expected" documents may be categorised depending upon the type of apparatus used, such as genuine banknotes, and in such a case unexpected documents may be banknotes which have failed to meet an authentication test based upon the data from the x-ray detector. It will also be appreciated that the gate 11 may represent a system which can divert banknotes along more than two paths, for example to separate the banknotes in terms of their denomination in addition to reject notes which are of an unexpected type, such as counterfeit notes. It will further be appreciated that the computer system 10 may receive information not only from the x-ray detector 8, but also from other detectors positioned along the transport path that are known in the art, these including visible, infrared or ultraviolet detectors in either or each of reflective or transmissive arrangements, together with various dimensional sensors including multiple thickness sensors.

The apparatus 100 is arranged to operate by analysing the banknote structure in one or more regions, some or all of which may include security features such as watermarks, optically variable elements and so on. As is known, such security features are present in a number of different denominations of currency from a number of different countries, their number, arrangement and type depending upon the banknote type in question.

Figure 2:
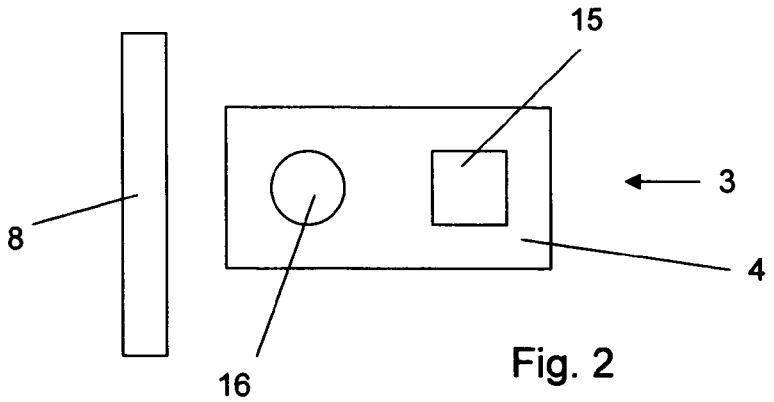
FIG. 2 shows a short edge feed arrangement for use with the example.

One arrangement of the apparatus of FIG. 1 is shown in FIG. 2, in which the transport mechanism is arranged as a "short edge feed" mechanism in which the short edges of the banknote are the leading and trailing edges as the banknote passes along the transport 1. This is illustrated by the arrow 3. For this reason, the detector 8 is arranged as a line scan camera in which the "line" is the dimension parallel to that of the short edge of the banknote. Thus, as the banknote passes adjacent to the detector 8, x-ray information is received from an area spanning its width. FIG. 2 also illustrates the existence of security features 15 and 16. Feature 15 is a watermark and 16 is a region containing intaglio and offset ink printing.

Typically the area of the banknote from which x-rays are received by the detector 8 is significantly narrower in a direction 3 than the banknote length. Thus when in use, the controller 6 repeatedly reads out data from the detector so as to build up a series of consecutive line scans of the note and these data are then processed by the computer 10. Preferably the regions from which the x-rays are detected upon the banknote are adjacent one another such that their edges interface, although it will be appreciated that this is not essential provided sufficient x-ray data is obtained from the features 15 and 16. An overlap of the line scan regions or spaces between the regions is therefore contemplated.

Figure 3:
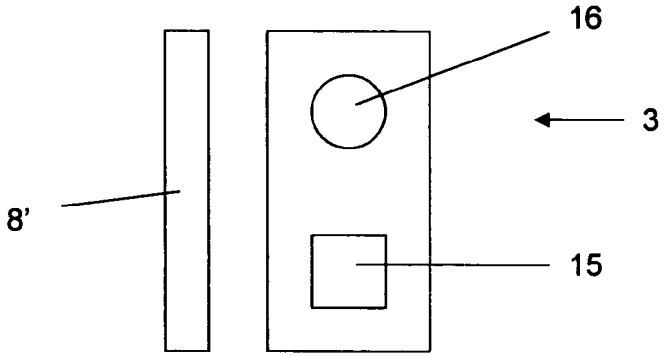
FIG. 3 shows an alternative long edge feed arrangement.

An alternative feed arrangement is shown in FIG. 3 in which the banknote is conveyed in a "long edge" feed configuration, the long edge therefore forming the leading and trailing edges of the note as it passes along the transport path 1. As will be appreciated in this case, the extent of the detector 8' need only be that of a length and position sufficient to read information from the feature in question. Two detectors may be provided to observe the features 15 and 16 although in the present case a single detector is used having a length at least equal to that of the banknote long edge.

Figure 4A:
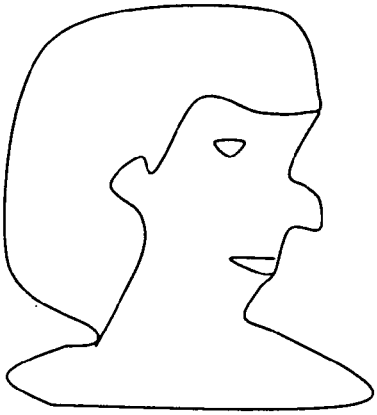
FIG. 4*a* shows a watermark security feature.
Figure 4B:
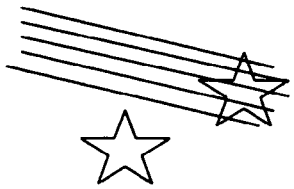
FIG. 4*b* shows an intaglio and offset printing security feature.

FIG. 4*a* shows a schematic representation of a security feature in the form of a watermark. In the present case this is an "image" watermark where the details of the image are provided by various density variations in the banknote substrate (typically a paper substrate). FIG. 4*b* shows an example of the security feature 16 in which the parallel lines denote intaglio printed ink, and where the stars denote offset printed ink. When viewed under transmissive x-ray conditions for example, the watermark of FIG. 4*a* will show contrast intensity variations dependent upon the density (and thickness) of the paper substrate, thus darker regions will occur due to greater absorption denoting greater paper density and/or thickness. In FIG. 4*b*, the intaglio printed lines will typically provide significantly reduced intensity with respect to the background, and with respect to the star shaped offset printing. This assumes that the inks used in each case are of approximately similar composition, although the use of large atomic number metal oxides within the offset printing ink for example may cause the contrast between the two printing types to be reduced. In any case, the apparatus may be controlled so as to maximise the contrast difference between the substrate, the offset printed ink, and the intaglio printed ink.

Figure 5A:
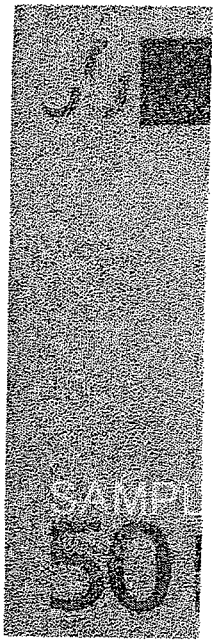
FIG. 5*a* is an example of a reflective optical image of a 50 Euro banknote containing an image watermark.
Figure 5B:
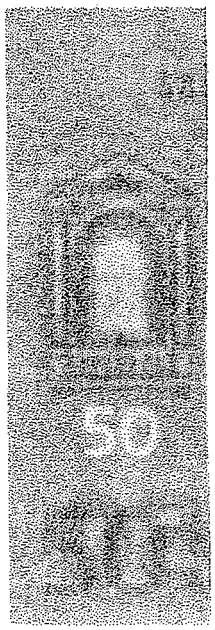
FIG. 5*b* shows a similar region using an x-ray transmissive image.
Figure 5C:
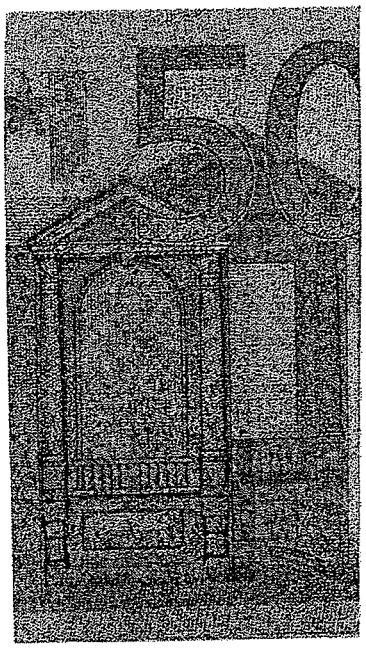
FIG. 5*c* shows a second region with intaglio and offset printing using reflective optical imaging.
Figure 5D:
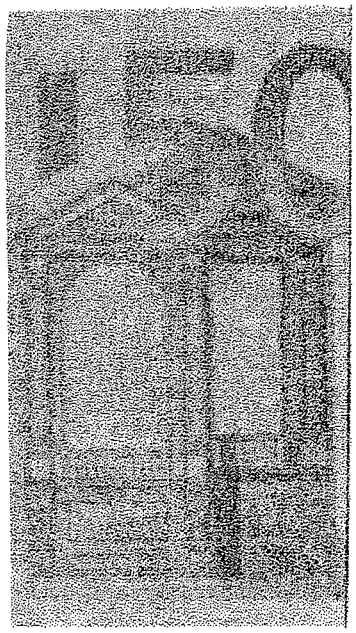
FIG. 5*d* shows the second region using x-ray inspection.
Figure 5E:
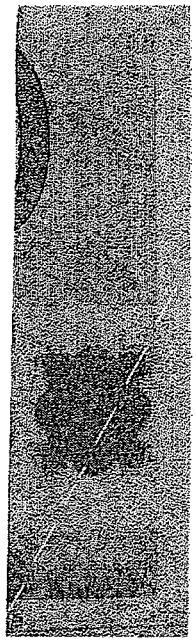
FIG. 5*e* shows another region having an optically variable element using reflective optical imaging.
Figure 5F:
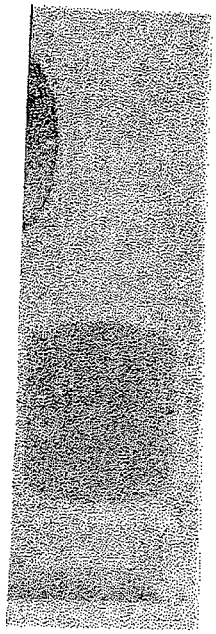
FIG. 5*f* shows the optically variable element using x-ray inspection.

To illustrate the x-ray image contrast provided by magnetic materials already used within banknotes, reference is now made to FIGS. 5*a* to 5*g*. FIG. 5*a* is an optical image of a region of a 50 Euro banknote containing an image watermark. FIG. 5*b* shows the same region upon the same banknote under x-ray inspection. The watermark is all but invisible in the reflective optical image of FIG. 5*a* but is clearly visible in FIG. 5*b*. Notably it is primarily the density variations in the substrate material that provides the contrast in this particular image. FIG. 5*c* shows a reflective optical image of a second region of a 50 Euro banknote containing intaglio printing (the building) and offset printing (star shapes). FIG. 5*d* shows the same region with x-ray inspection, illustrating how, at this level of contrast, the intaglio printing can be clearly distinguished from the offset printing. A third region is illustrated in FIGS. 5*e* and 5*f*. FIG. 5*e* shows an optically reflective image of an optically variable element (such as a hologram) within a 50 Euro banknote. A similar region is shown in FIG. 5*f*, this being inspected with x-rays. It is notable that the aluminised region defining the intricate reflective metallic surface in the optical image is not represented in the x-ray image. The conditions used for the x-ray image 5*f* show up the transfer substrate used to provide the optically variable element on to the particular note in question.

Figure 5G:
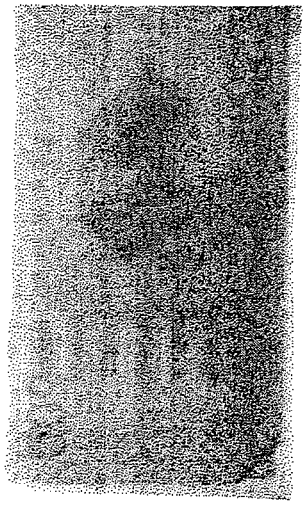
FIG. 5*g* shows tape upon a banknote when viewed using x-ray inspection; and, FIG. 6 is a flow diagram of an example method.

Whilst much of the above discussion has focussed upon the presence of security features within a banknote, the apparatus and method may also be used to distinguish between the features intentionally positioned upon the banknote by the manufacturer, and those provided either accidentally or deliberately by third parties, such as tape. Thus as can be seen in FIG. 5*g*, the provision of cellophane tape (upper) and matt clear tape (lower) can be clearly distinguished in an x-ray image whereas the latter matt tape is particularly difficult to detect automatically by conventional optical techniques.

Turning now to the use of the data generated by the x-ray detector 8, there are a number of ways in which the information may be processed, depending upon the intended use of the apparatus 100.

In very a basic example, line scan data from the detector 8 can be analysed by monitoring the number of "pixels" from the x-ray detector which provide a transmissive intensity level below a predetermined threshold (data corresponding to "dark" pixels). Thus, regardless of the positional information, if more than a predetermined number of pixels meet the threshold requirement, or the number of pixels meeting such a requirement lies within a predetermined range, then various security features having expected contrast can be deemed to be present. With this simple level of analysis, the banknote in question can be deemed to be of an "expected" type and is therefore directed, via gate 11, along the transport path branch 12. Any banknotes not meeting this criterion are diverted along the "unexpected" path 13 as controlled by the computer 10. Such a test only provides a very basic test and no spatial information regarding the position of the features is used in this case.

In a more advanced and preferred alternative, data representing consecutive scan lines from the detector 8 are formed into image data, this for example being represented by the image illustrated in FIG. 5*b*. The data are then analysed by image analysis techniques analogous to those used in optical imaging of banknotes. This is now discussed in more detail with reference to FIG. 6 which is a flow diagram of such a method.

Figure 6:
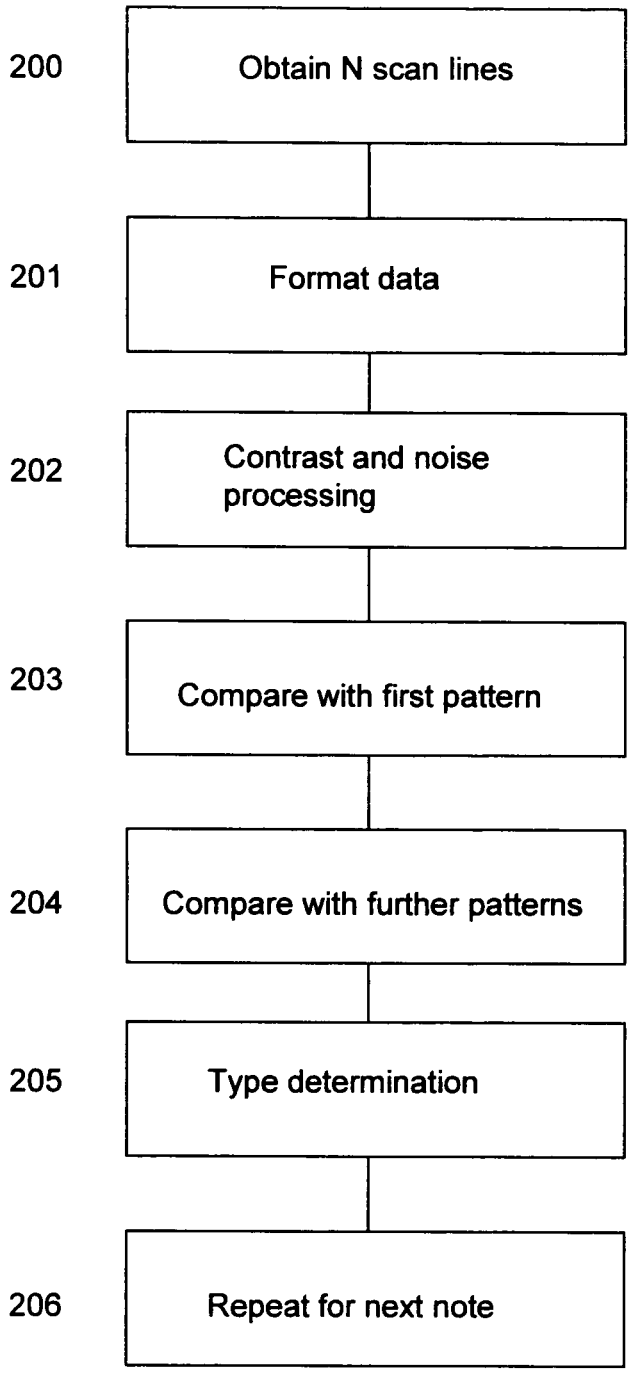

In FIG. 6, at step 200, the x-ray source 5 and detector 8 are controlled by the controller in response to instruction from the computer 10 so as to produce an optimised level of contrast for a given transport path speed and type of banknote, which may also depend upon the features to be inspected. For a given banknote passing along the transport path 1 between the source 5 and detector 8, N lines of scan data are obtained via the controller 6 from the x-ray detector 8.

As will be appreciated, each scan line contains a large quantity of "pixel" data, including an x-ray intensity for each pixel along the line of the detector. At step 201, the scan lines are arranged in a predetermined format for processing. This may include arranging the data in a store in which the pixels on different scan lines are represented consecutively in a data stream.

At step 202, the data are processed according to contrast criteria to ensure that the expected contrast levels for such data have been received. Some processing analogous to "gamma correction" may be performed depending upon the known intensity response of the detector. This step may also involve further processing steps to reduce noise within the data.

At step 203, a first "master" image or pattern is obtained from a store within the computer 10, and the data are compared with the master pattern data. The data of the master and that obtained from the detector correspond to similar regions of the banknote, specifically the security features regions 15, 16 in this example. The master represents nominal image data from a genuine banknote in a given orientation. The master may be generated by using the apparatus to scan numerous genuine banknotes. This inspection of the banknote in the inspection position of the transport path is provided by examining at least one region where a security feature is expected to be present. In many cases multiple regions will be inspected within the data. In order to identify the existence of tape or other foreign matter it is advantageous to treat the entire banknote as the inspection region, at least at a sufficient resolution to detect the presence of such matter. Higher resolution processing may then be performed in regions of the image where security features are expected.

At step 204, similar comparisons are made with two or more other master patterns. Typically four master patterns are provided for each type of banknote, these relating to the four different possible ways that a banknote may be fed in a short edge feed or long edge feed mode.

At step 205, a "type" determination is made based upon the comparison steps 203 and 204. Specifically, if one of the master patterns matches the data corresponding to that received by the detector to a sufficient predetermined degree of accuracy then a corresponding output signal is generated, and used to control the gate 11 to direct the note along the "expected" transport path branch. If an insufficient match is obtained with each of the master patterns, then the note is determined as an unexpected type and is sent along the path branch 13.

At step 206, the process returns to step 200 so as to analyse the next note in the transport path. The computer 10 may make adjustments to the operational parameters of the source and detector (such as power or gain) or the speed of the transport path at each step 200 so as to maximise the accuracy of the analysis. Such adjustments may be made based upon the data received from one or more banknotes analysed in previous steps.

It will further be appreciated that different denominations of note may be distinguished using the method of FIG. 6 since these typically have different security features. A great advantage of the invention is derived from the backwards compatibility of the invention with security features already in circulation.

Whilst four patterns may be used for each type of denomination, if there are five different denomination types for a particular currency, then 20 different patterns may be used for comparison. If the apparatus is arranged to distinguish between two or more different types of denomination within the "expected" types, together with unexpected types, then either a multiple path gate 11 may be used, or the path 12 may be subdivided into further paths downstream using one or more further gates.

It should be noted that in step 202, following the contrast and noise processing, it may be quickly determined that a note of unexpected types is present since the expected contrast or intensity range within the data may not be present. This note may therefore be rejected as an unexpected type at step 202. Of course this may be due to the note being counterfeit or, in the case of a genuine note being present, it may indicate a malfunction with the detector or the source, or possibly a misfeed. In this way an additional functionality of multiple feed detection may be achieved.

With the method illustrated in FIG. 6, it will be appreciated that a short edge feed or a long edge feed may be used.

The apparatus discussed above may be used in various different types of different document processing systems. For example, it may be used in systems to distinguish between types of document, when determining different denominations of document, or in an authentication system. It will be appreciated that the system may be used in conjunction with other detection techniques, including optical, ultraviolet, infrared, magnetic and dimensional techniques so as to improve the accuracy of document processing by inspecting either similar or dissimilar features to those inspected using x-rays.

The invention claimed is:

1. An apparatus for analysing a security document, the apparatus comprising:

an x-ray source adapted to illuminate at least one inspection region of the security document when located at an inspection position;

an x-ray detector adapted to receive x-rays from the at least one inspection region of the security document and to generate a detector response;

a processor adapted to analyse the detector response by forming the detector response into x-ray image data, and using an image analysis process upon the x-ray image data to generate an output signal indicative of a structure of the security document in the at least one inspection region; and a transport path comprising a driven roller and a guide configured to transport the security document through the inspection position, without user input, wherein the apparatus is configured such that the x-ray source illuminates the security document when in the inspection position, wherein said image analysis process compares the security document to four master patterns of genuine security documents, the four master patterns corresponding to each of four ways in which the security document may be fed along the transport path.

2. The apparatus according to claim 1, wherein the security document is fed along the transport path by a leading edge and wherein a length of the detector is equal to at least a length of the leading edge.

3. The apparatus according to claim 1, wherein the x-ray source and the x-ray detector are located upon opposite sides of the transport path according to a transmissive arrangement.

4. The apparatus according to claim 1 wherein the x-ray source and/or the x-ray detector are positioned approximately normally to a face of the security document as the security document passes along the transport path.

5. The apparatus according to claim 1, wherein the apparatus is adapted to locate areas of differing x-ray absorption or fluorescence within said at least one inspection region.

6. The apparatus according to claim 5, wherein the apparatus is adapted to locate differences in one or more of density, thickness or material within said at least one inspection region.

7. The apparatus according to claim 5, wherein the x-ray source and the x-ray detector are adapted to generate sufficient x-ray contrast so as to locate a position of said at least one inspection region.

8. The apparatus according to claim 1, wherein the x-ray detector is a line scan detector.

9. The apparatus according to claim 1, wherein the processor is adapted to analyse the detector response by comparing an obtained response with a predetermined response.

10. The apparatus to claim 9, wherein the processor is adapted to generate an image of the at least one inspection region formed from a number of detector responses generated at different locations for each of a plurality of security documents.

11. The apparatus according to claim 10, wherein the processor is adapted to compare the image with one or more predetermined master images.

12. The apparatus according to claim 9, wherein the output signal is dependent upon a degree of correspondence between the obtained response and the predetermined response.

13. The apparatus according to claim 1, wherein the apparatus is a document sorter for sorting documents according to their type.

14. The apparatus according to claim 1, wherein the apparatus is a document authenticator for sorting genuine documents from counterfeit documents.

15. The apparatus according to claim 1, wherein the apparatus is a banknote processing apparatus and wherein the security document is a banknote.

16. The apparatus according to claim 1, wherein a plurality of security documents are processed at a rate of 600 per minute or more.

17. A method of analysing a security document, the method comprising:

transporting, without user input, the security document to and from an inspection position along a transport path, which comprises a driven roller and a guide;

illuminating at least one inspection region of the security document with x-rays from an x-ray source, whilst the document is in the inspection position;

receiving x-rays from the at least one inspection region at an x-ray detector adapted to generate a corresponding detector response;

analysing the detector response by forming the detector response into x-ray image data and using an image analysis process upon the x-ray image data so as to generate an output signal indicative of the structure of the document within the at least one inspection region; and comparing the security document to four master patterns of genuine security documents, the four master patterns corresponding to each of four ways in which the security document may be fed along the transport path.

18. The method according to claim 17, wherein the document is in motion whilst the x-rays are received.

19. The method according to claim 17, further comprising processing data representative of the detector response so as to modify the intensity contrast.

20. The method according to claim 17, further comprising processing data representative of the detector response so as to reduce noise.

21. The method according to claim 17, wherein the structure is analysed by locating areas of differing x-ray absorption or fluorescence within said at least one inspection region.

22. The method according to claim 21, wherein the structure is analysed by locating differences in one or more of density, thickness or material within said at least one inspection region.

23. The method according to claim 22, wherein the at least one inspection region contains a watermark that is configured to receive the x-rays illuminated from the x-ray source.

24. The method according to claim 22, wherein the at least one inspection region contains an optically variable element that is configured to receive the x-rays illuminated from the x-ray source.

25. The method according to claim 22, wherein the at least one inspection region contains foreign matter that is configured to receive the x-rays illuminated from the x-ray source.

26. The method according to claim 25, wherein the foreign matter is tape.

27. The method according to claim 17, wherein the analysis comprises comparing the detector response with a threshold intensity level.

28. The method according to claim 17, wherein the analysis comprises comparing the detector response with one or more master patterns corresponding to expected document types.

29. The method according to claim 17, wherein the output signal is indicative of whether the document is of an expected type or an unexpected type.

30. The method according to claim 29, further comprising diverting documents of an expected type along a first transport path and those of an unexpected type along a second document path.

31. The apparatus according to claim 1, wherein the transport path is configured to branch into a plurality of routes, and the processor, without user input, is configured to: i) route a genuine security document along a first of the plurality of routes, and ii) route a non-genuine security document along a second of the plurality of routes.

32. The method according to claim 17, further comprising: branching the transport path into a plurality of routes; and routing, without user input, a genuine security document along a first of the plurality of routes and a non-genuine security document along a second of the plurality of routes.

* * * * *